US006166495A

United States Patent [19]

Newell et al.

[11] Patent Number: 6,166,495

[45] Date of Patent: Dec. 26, 2000

[54] SQUARE WAVE BALLAST FOR MERCURY FREE ARC LAMP

[75] Inventors: P. Bruce Newell, Carlisle; Nanu Brates, Malden, both of Mass.

[73] Assignee: Osram Sylvania Inc., Danvers, Mass.

[21] Appl. No.: 09/413,924

[22] Filed: Oct. 7, 1999

Related U.S. Application Data

[60] Provisional application No. 60/129,244, Apr. 14, 1999.

[51] Int. Cl.[7] ..... H05B 37/00

[52] U.S. Cl. ..... 315/291; 315/DIG. 5; 313/636; 313/637

[58] Field of Search ..... 313/634–643; 315/291, 209 R, DIG. 5

[56] References Cited

U.S. PATENT DOCUMENTS 5,517,088 5/1996 Blom ..... 315/289
5,973,453 10/1999 Van Vliet et al. ..... 313/623

*Primary Examiner*—David Vu
*Attorney, Agent, or Firm*—William H. McNeill

[57] ABSTRACT

A ballast for a mercury-free, metal halide arc lamp having a quartz or fused silica envelope. The ballast provides a square-wave voltage, which substantially reduces or eliminates the re-ignition voltage in the mercury-free, metal halide arc lamp. The ballast reverses the voltage polarity, and reestablishes the arc current in the opposite direction, before the free halogen in the envelope can quench the arc.

8 Claims, 3 Drawing Sheets

SQUARE WAVE BALLAST FOR MERCURY FREE ARC LAMP

This application claims priority from Provisional Application Ser. No.: 60/129,244, filed Apr. 14, 1999.

FIELD OF THE INVENTION

This invention relates to metal halide arc lamps and, more particularly, to a ballast for a mercury-free, metal halide arc lamp having an arc containing envelope of fused silica or ceramic.

BACKGROUND OF THE INVENTION

Mercury arc lamps containing iodides of sodium, scandium and/or rare-earths develop voltage waveforms characterized by "spikes" of voltage appearing on the leading edge of each half-cycle of alternating current. This phenomenon is known in the lighting industry as "re-ignition voltage." Re-ignition voltage occurs as the alternating current passes through zero. The free iodine in the lamp envelope quenches the arc, which then partially extinguishes. In order to reestablish the arc with the current in the opposite direction, the voltage must be caused to rise, momentarily well above the sustaining voltage. The more free iodine in the lamp, the greater the re-ignition voltage.

In a typical metal halide lamp, the ratio of the re-ignition voltage to the RMS (or crest factor) voltage is about 1.2 to 1.5. In a mercury-free lamp, such as that described in copending United States patent applications entitled MERCURY-FREE METAL HALIDE ARC LAMP and CHEMICAL COMPOSITION FOR MERCURY-FREE METAL HALIDE LAMP, by P. B. Newell et al., application serial nos. 09/413,923 and 09/413,922, the re-ignition voltage increases with increasing envelope temperature (and vapor pressure of the salts) just as the performance measures of the lamp become attractive.

It has been discovered that when the voltage ratio (crest factor) exceeds 4, the re-ignition voltage often exceeds the open circuit voltage of the ballast, and the lamp extinguishes or goes out. Operation of the lamp at increased temperature becomes unstable. Small variations in power and temperature are observed to cause large variations in re-ignition voltage and oscillatory behavior.

The present invention features a ballast having a square-wave power supply for a mercury-free, metal halide arc lamp having a fused silica or ceramic envelope of, for example, polycrystalline alumina. The square-wave power supply reduces and, in some cases, eliminates the re-ignition voltage in the mercury-free arc lamp. The supply works by reversing the voltage polarity and reestablishing the arc current in the opposite direction before the free halogen (e.g., iodine) in the envelope can quench the arc. Switching times less than one microsecond accomplish this goal. Small inductances in series with the lamp from an igniter, for example, slow the switching time. The re-ignition voltages may then reappear.

DISCUSSION OF RELATED ART

Square-wave electronic ballasts for mercury-free, metal halide lamps are known. The lamp has a ceramic discharge vessel, a luminous efficacy of at least 75 lumens/W, and a color rendering index of at least 75. During the alteration of polarity, the voltage variation rate is at least 0.3 V/$\mu$s, and is preferably 3.0 V/$\mu$s. Compared to the lamp of this invention, the switching rate of the known lamp is much higher.

SUMMARY OF THE INVENTION

In accordance with the present invention, there is provided a ballast for a mercury-free, metal halide arc lamp having a quartz or fused silica envelope. The ballast provides a square-wave voltage, which substantially reduces or eliminates the re-ignition voltage in the mercury-free, metal halide arc lamp. The ballast reverses the voltage polarity and re-establishes the arc current in the opposite direction, before the free halogen in the envelope can quench the arc. Switching times are less than one microsecond.

It is an object of this invention to provide an improved power supply or ballast for a mercury-free, metal halide arc lamp.

It is another object of the invention to provide a ballast for a mercury-free, metal halide arc lamp that provides a square-wave voltage to eliminate voltage spiking.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Generally speaking, the invention features a ballast for a mercury-free, metal halide arc lamp having a quartz or fused silica envelope. The ballast provides a square-wave voltage, which substantially reduces or eliminates the re-ignition voltage in the mercury-free, metal halide arc lamp. The ballast reverses the voltage polarity and reestablishes the arc current in the opposite direction, before the free halogen in the envelope can quench the arc. Switching times are less than one microsecond.

Figure 1:
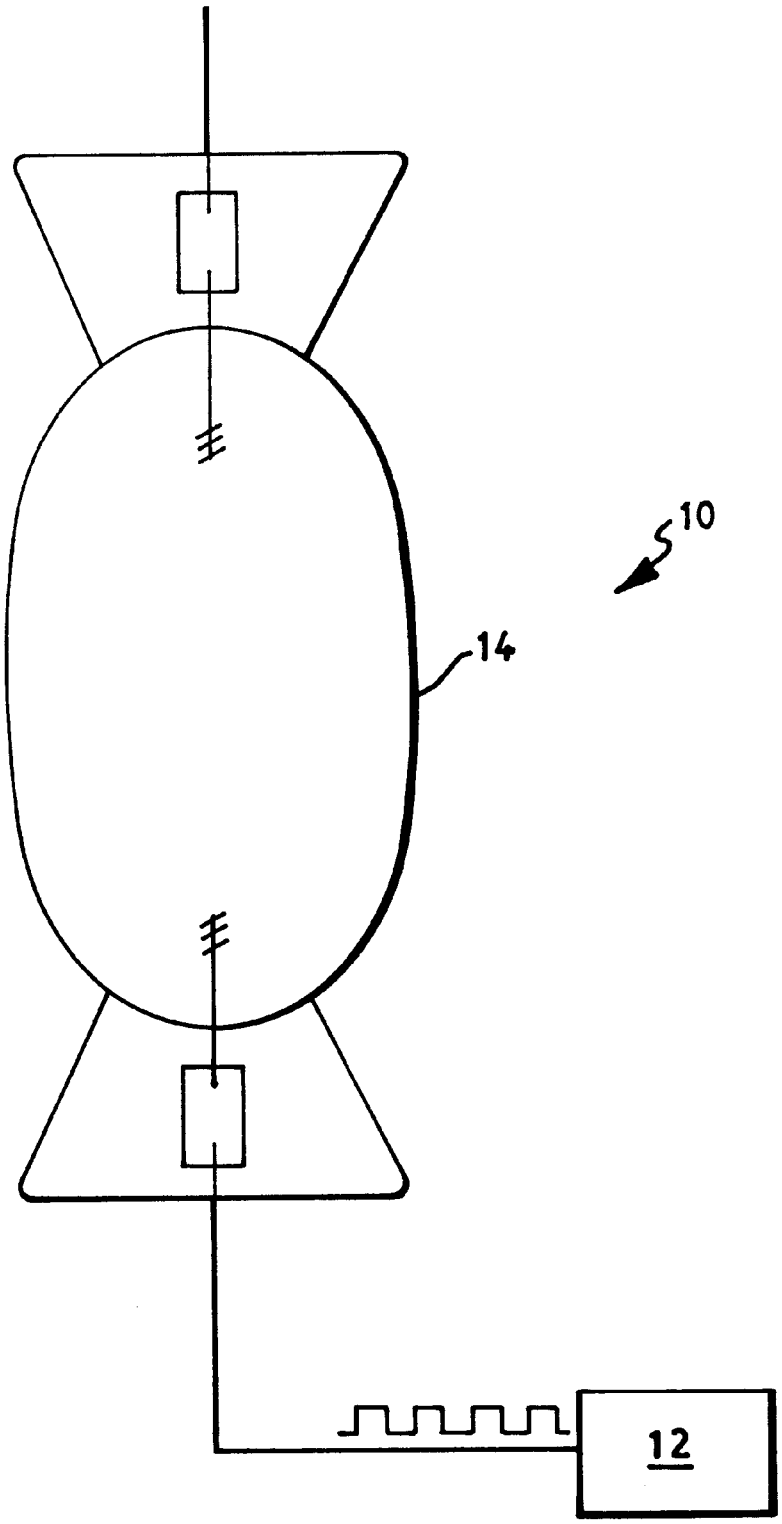
FIG. 1 illustrates a schematic view of the ballast and typical metal halide lamp of this invention.

Now referring to FIG. 1, a mercury-free, metal halide arc lamp 10 is shown being powered by a ballast 12 that provides the lamp 10 with a square-wave voltage. The envelope 14 of the lamp 10 is either quartz or fused silica. The switching time of the ballast 12 is less than approximately one microsecond. The ballast can operate in a range of frequencies from 50 to 5000 Hz with a preferred ranges being 300 to 400 Hz.

Figure 2:
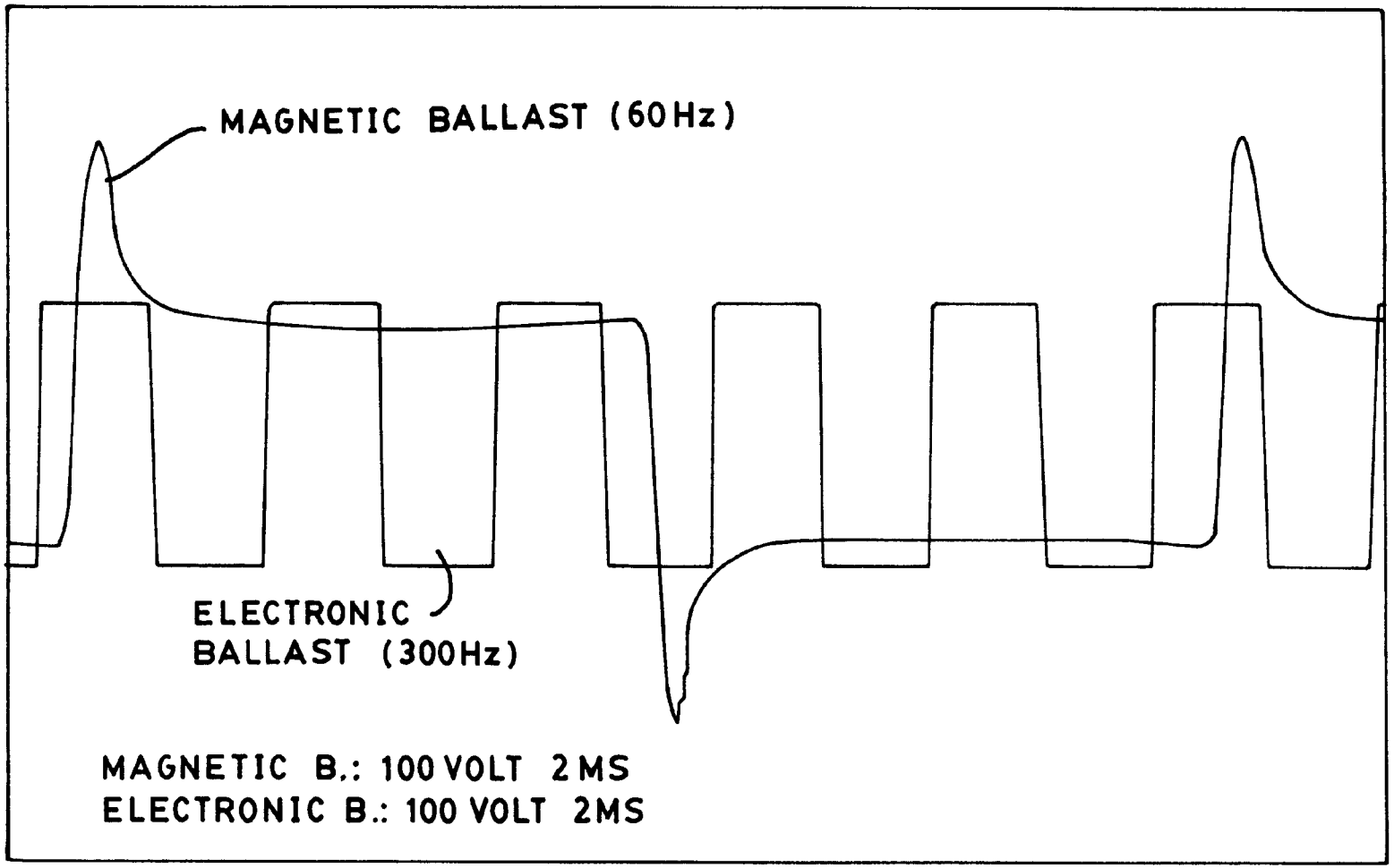
FIG. 2 depicts a graphical view of the square-wave voltage of the electronic ballast of this invention superimposed upon a typical magnetic ballast.

Referring to FIG. 2, a voltage waveform of the mercury-free, metal halide lamp 10 illustrated in FIG. 1 operates on a square-wave electronic ballast 12. In the figures the square-wave voltage is superimposed upon the voltage waveform of a magnetic ballast. It can be observed that no re-ignition voltage occurs with the electronic ballast 12 supplying the square-wave voltage. In the particular case shown here, the electronic ballast 12 of this invention operated at 300 Hz and delivered 400 watts to the lamp 10.

It was discovered that, in addition to eliminating the re-ignition voltage, the ballast 12 of the invention operated the mercury-free lamp 10 with more efficacy. The lamp 10 produced significantly more light operating on a square-wave ballast than when operating on a magnetic ballast.

Figure 3:
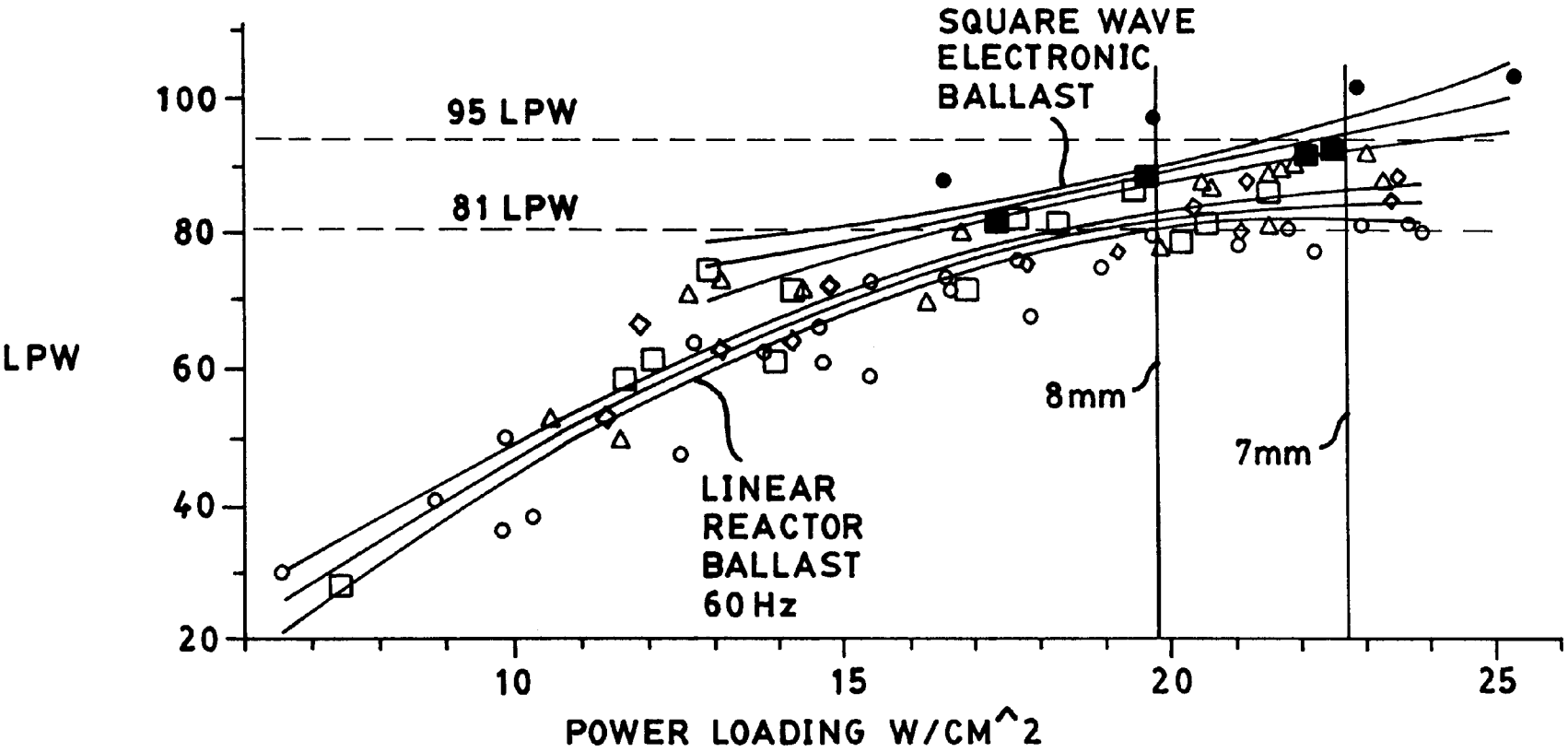
FIG. 3 shows a graphical view of lumens per watt versus power loading for mercury free metal halide lamps powered by inductive and square-wave power supplies.

Referring to FIG. 3, it can be observed that efficacy in lumens per watt versus power loading (in watts per square centimeter of envelope wall) produces a higher light output. The graph depicts a number of arc tubes with bores ranging from 6 mm to 10 mm. The curves with 95% confidence intervals represent a mathematical "best fit" to the data. The predicted efficacy of a 7 mm bore lamp operating on a magnetic ballast at 400 watts is 83 lumens per watt, while the predicted efficacy of the same lamp operating on a square-wave ballast is 95 lumens per watt. This is a 15% increase in efficacy.

A preferred embodiment of this invention consists of a mercury-free lamp, such as described in the aforementioned patent applications, Ser. Nos. (Attorney Docket No. 98-1-311) and (Attorney Docket No.: 98-1-322), operating on a 300 Hz square-wave ballast with a switching time less than one microsecond. If an igniter is used in the circuit, its inductance must be so small that it does not increase switching time to the point where re-ignition voltages reappear.

While there have been shown and described what are at present considered the preferred embodiments of the invention, it will be apparent to those skilled in the art that various changes and modifications can be made herein without departing from the scope of the invention as defined by the appended claims.

What is claimed is:

1. A mercury-free, metal halide lamp having an arc containing envelope, and square-wave electronic ballast supplying a square-wave voltage to said mercury-free, metal halide lamp, said square-wave voltage substantially eliminating re-ignition voltages from said mercury-free, metal halide lamp.

2. The mercury-free, metal halide lamp and square-wave electronic ballast in accordance with claim 1, operating in a frequency range from approximately 50 to 5000 Hz.

3. A mercury-free, metal halide lamp having a fused silica envelope, and square-wave electronic ballast supplying a square-wave voltage to said mercury-free, metal halide lamp, said square-wave voltage substantially eliminating re-ignition voltages from said mercury-free, metal halide lamp.

4. The mercury-free, metal halide lamp and square-wave electronic ballast in accordance with claim 3, operating in a frequency range from approximately 50 to 5000 Hz.

5. A mercury-free, metal halide lamp and square-wave electronic ballast supplying a square-wave voltage to said mercury-free, metal halide lamp, said squarewave voltage substantially eliminating re-ignition voltages from said mercury-free, metal halide lamp, and having a switching time of less than approximately one microsecond.

6. The mercury-free, metal halide lamp and square-wave electronic ballast in accordance with claim 5, operating in a frequency range from approximately 50 to 5000 Hz.

7. The mercury-free, metal halide lamp of claim 1 wherein said arc containing envelope is a ceramic material.

8. The mercury-free, metal halide lamp of claim 7 wherein said ceramic material is polycrystalline alumina.

* * * * *